US010113410B2

(12) United States Patent
Stephens et al.

(10) Patent No.: US 10,113,410 B2
(45) Date of Patent: Oct. 30, 2018

(54) SYSTEMS AND METHODS FOR WIRELESSLY MONITORING WELL INTEGRITY

(71) Applicant: ONESUBSEA IP UK LIMITED, London (GB)

(72) Inventors: James Ernest Stephens, Richmond, TX (US); Aleksander Pawel Cywinski, Celle (DE)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 15/282,307

(22) Filed: Sep. 30, 2016

(65) Prior Publication Data

US 2018/0094519 A1 Apr. 5, 2018

(51) Int. Cl.

| | |
|---|---|
| ***E21B 43/01*** | (2006.01) |
| ***E21B 47/12*** | (2012.01) |
| ***E21B 47/00*** | (2012.01) |
| ***E21B 33/035*** | (2006.01) |
| ***E21B 47/06*** | (2012.01) |

(52) U.S. Cl.

CPC ..... *E21B 47/0001* (2013.01); *E21B 33/035* (2013.01); *E21B 33/0355* (2013.01); *E21B 43/01* (2013.01); *E21B 47/0005* (2013.01); *E21B 47/0006* (2013.01); *E21B 47/065* (2013.01); *E21B 47/12* (2013.01); *E21B 47/122* (2013.01)

(58) Field of Classification Search

CPC .. E21B 47/0001; E21B 33/0355; E21B 43/01; E21B 47/0006; E21B 47/065; E21B 47/1222

See application file for complete search history.

(56) References Cited

U.S. PATENT DOCUMENTS

| | | | | |
|---|---|---|---|---|
| 6,408,943 | B1 * | 6/2002 | Schultz | E21B 7/061 166/250.01 |
| 7,231,970 | B2 | 6/2007 | Matusek et al. | |
| 7,762,338 | B2 | 7/2010 | Fenton et al. | |
| 8,434,354 | B2 * | 5/2013 | Crow | E21B 41/0064 73/152.04 |
| 8,672,040 | B2 | 3/2014 | Kobata et al. | |
| 9,410,420 | B2 * | 8/2016 | Ross | E21B 47/122 |
| 9,435,190 | B2 * | 9/2016 | Mulholland | E21B 47/0001 |

(Continued)

FOREIGN PATENT DOCUMENTS

WO 2016010517 A1 1/2016

OTHER PUBLICATIONS

Communication from the European Patent Office of the Extended European Search Report for EP Application No. EP17193920, dated Apr. 13, 2018, 8 pgs.

*Primary Examiner* — Anna M Momper
*Assistant Examiner* — Douglas S Wood
(74) *Attorney, Agent, or Firm* — Fletcher Yoder P.C.

(57) ABSTRACT

A well integrity monitoring system may include one or more sensing elements that are configured to generate feedback indicative of an integrity of a well. The one or more sensing elements may be disposed in at least one annulus of wellhead assembly. Additionally, the well integrity monitoring system may include a controller coupled to the wellhead assembly. The controller may be configured to wirelessly determine the feedback from the one or more sensing elements.

18 Claims, 7 Drawing Sheets

(56) References Cited

U.S. PATENT DOCUMENTS

| | | | | |
|---|---|---|---|---|
| 9,528,364 | B2 * | 12/2016 | Samuel | E21B 47/00 |
| 2008/0070499 | A1 * | 3/2008 | Wilhelm | H04B 5/00 455/41.1 |
| 2009/0212969 | A1 | 8/2009 | Voss | |
| 2011/0226490 | A1 | 9/2011 | Nguyen | |
| 2012/0098674 | A1 | 4/2012 | McStay et al. | |
| 2013/0056218 | A1 | 3/2013 | McCoy, Jr. et al. | |
| 2013/0269945 | A1 | 10/2013 | Mulholland et al. | |
| 2013/0299165 | A1 | 11/2013 | Crow | |
| 2014/0014334 | A1 | 1/2014 | Mason et al. | |
| 2014/0251630 | A1 | 9/2014 | Reimert et al. | |

* cited by examiner

SYSTEMS AND METHODS FOR WIRELESSLY MONITORING WELL INTEGRITY

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are a common source of fuel for a variety of applications. For example, oil and gas are often used to heat homes, to power vehicles, and to generate electrical power. Drilling and production systems are typically employed to access, extract, and otherwise harvest desired natural resources, such as oil and gas, from geological formations that are located below the surface of the earth. For example, in order to extract natural resources from a subterranean formation, a well may be drilled in the subterranean formation, and pipes (e.g., casing) may be installed in the well. The pipes are often cemented into place in the well, with cement between the pipes and cement between the pipes and the subterranean formation. To complete the well, the cement and one or more of the pipes may be perforated to establish fluid communication between the well and the subterranean formation. The cement and the pipes may block or prevent fluids (e.g., oil, gas, and/or hydrocarbons) from flowing from the subterranean formation through the well to the surface of the earth or to other subterranean formations. The ability or functionality of the cement and the pipes, as well as other components of the system, in blocking or preventing the flow of fluids from the subterranean formation to the surface and to other subterranean formations is often referred to as well integrity. Managing well integrity may increase the life of the well and may reduce operating costs of the well.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION

Figure 1:
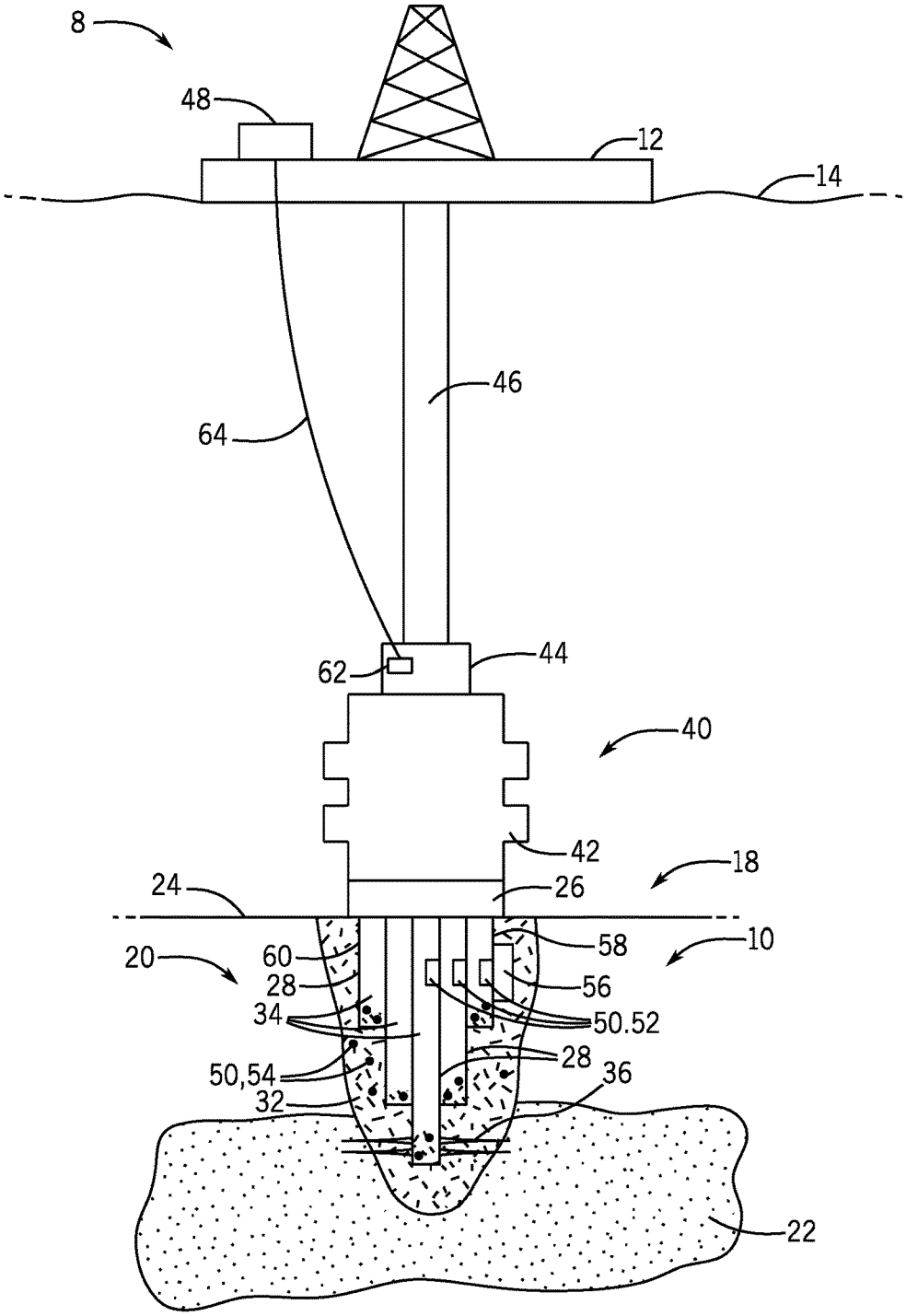
FIG. 1 is a schematic view of an embodiment of a mineral extraction system including a wellhead assembly and a well integrity monitoring system.

One or more specific embodiments of the present disclosure will be described below. These described embodiments are only exemplary of the present disclosure. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The drawing figures are not necessarily to scale. Certain features of the embodiments may be shown exaggerated in scale or in somewhat schematic form, and some details of conventional elements may not be shown in the interest of clarity and conciseness. Although one or more embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

When introducing elements of various embodiments of the present disclosure, the articles "a," "an," and "the" are intended to mean that there are one or more of the elements. The terms "comprising," "including," and "having" are used in an open-ended fashion, and thus should be interpreted to mean "including, but not limited to . . . ". Any use of any form of the terms "connect," "engage," "couple," "attach," "mate," "mount," or any other term describing an interaction between elements is intended to mean either an indirect or a direct interaction between the elements described.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

As discussed below, a well may be drilled into a subterranean formation, and a wellhead assembly may be coupled to the well to enable extraction of various minerals, such as oil, gas, and/or hydrocarbons, from the subterranean formation. In particular, the wellhead assembly may include a wellhead and a plurality of strings, which extend from the wellhead into a wellbore of the well. The strings may be cemented into place in the well by circulating cement between the strings and the subterranean formation. To complete the well, holes may be formed in the cement and in at least one string of the wellhead assembly to enable fluid communication between the subterranean formation and the wellhead assembly. The wellhead assembly, including wellhead, the strings, and/or the cement, may prevent or block the flow of fluids from the subterranean formation to the surface and to other subterranean formations through the wellbore.

After completion of the well, minerals may be produced or extracted from the subterranean formation using a production tree (e.g., a Christmas tree) coupled to the wellhead, for example. In some situations, the well may be abandoned. To abandon the well, the wellhead may be removed from the strings, and the strings may be plugged and cemented to prevent or block the flow of fluids from the subterranean formation to the surface and to other subterranean formations through the strings and through the well surrounding the strings. As used herein, the ability or functionality of the wellhead assembly (e.g., the wellhead, the strings, the cement, the plugs, etc.) in preventing or blocking the unintentional flow of fluids from the subterranean formation to the surface and to other subterranean formations (e.g., through the wellbore during drilling, completion, and/or production of the well and through the wellbore and the strings during abandonment of the well) is referred to as the well integrity of the well. Maintaining high well integrity (e.g., the wellhead assembly prevents or blocks the unintentional flow of fluids or maintains the unintentional flow of fluids within an acceptable range) may increase the life of the well and may reduce operating costs associated with the well.

The present disclosure is directed to embodiments of a system and method for wirelessly monitoring the well integrity of a well during drilling of the well, injection of the well, completion of the well, production of the well, and/or abandonment of the well. As discussed below, the disclosed embodiments include a well integrity monitoring system including one or more sensing elements (e.g., electronic sensor modules, temperature-sensitive cement additives, hydrocarbon-sensitive cement additives, etc.) that are configured to generate feedback indicative of the integrity of the well. In some embodiments, the sensing elements may be disposed on one or more strings of a wellhead assembly, disposed in one or more annuli of the wellhead assembly, disposed in cement in a wellbore of the well, and/or disposed in cement in one or more annuli of the wellhead assembly. Additionally, the well integrity monitoring system may include a surface controller generally located at a surface of the earth (e.g., a sea surface) and configured to receive the sensor feedback and to determine the well integrity based on the sensor feedback. In some embodiments, the controller may provide indications, alerts, and/or recommendations to a user (e.g., via an output device) based on the determined well integrity, which may facilitate a user in maintaining or increasing the well integrity. As such, the well integrity monitoring system may facilitate well integrity maintenance, which may increase the life of the well and may reduce operating costs associated with the well.

Further, the surface controller may be in wireless communication with the sensing elements. In particular, as discussed below, the well integrity monitoring system may include one or more sensor controllers coupled to the wellhead assembly (e.g., coupled to a conductor pipe) and configured to wirelessly determine the feedback generated by the sensing elements. For example, the sensor controllers may wirelessly receive signals from the sensing elements (e.g., electronic sensor modules) and/or may wirelessly detect a change in a parameter of the sensing elements (e.g., temperature-sensitive cement additives, hydrocarbon-sensitive cement additives, etc.) that is indicative of the well integrity. As discussed below, the sensor controllers may transmit the sensor feedback to the surface controller using wireless communication and/or one or more wired connections (e.g., wire lines). Further, in some embodiments, the sensing elements may include a power source and/or may wirelessly (e.g., inductively) receive power from the sensor controllers. As such, the well integrity monitoring system may establish communication between the sensing elements and the surface controller without utilizing an expensive wire line (e.g., umbilical) to connect each sensing element to the surface controller. Thus, the well integrity monitoring system may enable the monitoring and management of well integrity while reducing costs as compared to well integrity monitoring systems utilizing sensors that are hardwired to a surface controller.

FIG. 1 is a schematic view of an embodiment of a mineral extraction system 8 including a well integrity monitoring system 10. The mineral extraction system 8 may be configured to extract various minerals, such as oil, gas and/or hydrocarbons from the earth. In the illustrated embodiment, the mineral extraction system 8 is subsea (e.g., a subsea system, an offshore system, etc.). In certain embodiments, the mineral extraction system 8 may be land-based (e.g., a surface system). The mineral extraction system 8 may include a surface vessel or platform 12, such as a rig, generally located at a first surface 14 (e.g., a sea surface or a land surface).

Additionally, the mineral extraction system 8 may include a wellhead assembly 18 (e.g., a wellhead system, a subsea wellhead assembly) located below the first surface 14. In some embodiments, the wellhead assembly 18 may be located at greater than or equal to approximately 500 meters (m), 1,000 m, 2,000 m, 3,000 m, or more below the first surface 14. The wellhead assembly 18 couples to a well 20 to enable extraction of minerals from a subterranean formation 22 (e.g., a reservoir, a mineral deposit, etc.) disposed below a second surface 24 (e.g., a sea floor, a mudline, etc.) of the earth. The wellhead assembly 18 may include a wellhead 26 (e.g., wellhead housing), which may be generally located at or near the second surface 24.

Additionally, the wellhead assembly 18 may include a plurality of coaxial strings 28 (e.g., pipes, casing, and/or tubing) that extend from the wellhead 26 into a well-bore 30 of the well 20. The strings 28 may be cemented into place in the well 20. In particular, cement 32 may be disposed between the strings 28 and the subterranean formation 22 to block or prevent unintentional flow of fluids (e.g., oil, gas, and/or hydrocarbons) from the subterranean formation 22 to the surface 24 or to other subterranean formations below the surface 24. In some embodiments, the cement 32 may extend into annuli 34 formed between the strings 28. Further, the wellhead assembly 18 may include a plurality of perforations 36 (e.g., holes) that extend through the cement 32 and at least one string 28 of the plurality of strings 28 (e.g., casing strings) to establish fluid communication between the subterranean formation 22 and the wellhead assembly 18.

The wellhead assembly 18 may include multiple components that control and regulate activities and conditions associated with the well 20. For example, the wellhead assembly 18 may include components, such as bodies, valves, seals, a tree (e.g., a Christmas tree), and so forth, that route minerals extracted from the subterranean formation 22, regulate pressure in the well 20, and/or inject chemicals into the well 20. In some embodiments, the wellhead assembly 18 may be coupled to a blowout preventer (BOP) assembly 40 configured to seal the well 20 to block or prevent oil, gas, hydrocarbons, and/or other fluids from exiting the well 20 in the event of an unintentional release of pressure or an overpressure condition. In some embodiments, the BOP assembly 40 may include one or more of a BOP 42 (e.g., a BOP stack) and a lower marine riser package (LMRP) 44. The BOP 42 may include one or more preventers, spoils, valves, and/or controls and may be operatively coupled to the wellhead 26 of the wellhead assembly 18. The LMRP 44 may be operatively coupled to the BOP 42 and a conduit 46 (e.g., a riser, a marine riser, a pipeline, etc.) extending from the surface vessel or platform 12. The LMRP 44 may include a ball/flex joint coupled to the conduit 46, a conduit adapter (e.g., a marine riser adapter), and kill and auxiliary lines.

The mineral extraction system 8 also includes the well integrity monitoring system 10. As discussed below, the well integrity monitoring system 10 may be configured to wirelessly monitor the well integrity of the well 20 during drilling of the well 20, completion of the well 20, production of the well 20, injection of the well 20, and/or abandonment of the well 20. As used herein, the well integrity is the ability or functionality of the wellhead assembly 18 (e.g., the cement 32, the strings 28, the wellhead 26, and any other components of the wellhead assembly 18) to block or prevent the unintentional flow of fluids (e.g., oil, gas, hydrocarbons, or other fluids) from the subterranean formation 22 to the second surface 24 or to other subterranean formations below the second surface 24. The well integrity monitoring system 10 may include a controller 48 (e.g., a surface controller, a top-side controller, a processor-based controller, a master control module, etc.), which may be generally located at the first surface 14. In some embodiments, the controller 48 may be disposed on the surface vessel or platform 12. Additionally, the well integrity monitoring system 10 may include one or more sensing elements 50 (e.g., wireless sensing elements) configured to generate feedback indicative of or relating to a well integrity of the well 20. As discussed below, the controller 48 may be configured to wirelessly receive feedback from the sensing elements 50 (e.g., the sensor feedback) and to analyze or determine the well integrity based on the sensor feedback. Further, the controller 48 may provide one or more user-perceivable indications (e.g., alerts, alarms, recommendations, etc.) to a user (e.g., via an output device) and/or may control the mineral extraction system 8 based on the analysis of the well integrity.

The well integrity may be based on a plurality of parameters of the wellhead assembly 18, which may be referred to as well integrity parameters. In some embodiments, the well integrity parameters may include the pressure and/or temperature of fluid within one or more annuli 34 between the strings 28, which may be referred to as annulus parameters or annulus integrity parameters. For example, an excessive pressure build-up within an annulus 34 may occur due to thermal expansion of the fluid. In certain embodiments, the well integrity parameters may include parameters indicative of a structural integrity of the wellhead assembly 18, which may be referred to as fatigue parameters or structural integrity parameters of the wellhead assembly 18. For example, the fatigue parameters may include the stress (e.g., compressive stress), strain (e.g., tensile strain), bending (e.g., inclination), vibration, lateral displacement, and/or movement (e.g., acceleration) of the strings 28, the wellhead 26, and/or the wellhead assembly 18. Further, in some embodiments, the well integrity parameters may include parameters relating to the condition of the cement 32, which may be referred to as cement parameters or cement integrity parameters. In particular, the cement parameters may be used to determine whether one or more cracks are present in the cement 32, whether fluid is flow or leaking through the cement 32, the location of one or more cracks and/or leaks in the cement 32, and/or a degree or severity of the cracks and/or leaks in the cement 32. For example, the cement parameters may include the temperature of the cement 32 and/or the presence, amount, or flow rate of oil, gas, hydrocarbons, or other fluids in the cement 32.

Accordingly, as discussed below, the sensing elements 50 may be configured to generate feedback relating to one or more well integrity parameters, such as the annulus parameters, the fatigue parameters, and/or the cement parameters. The sensing elements 50 may be disposed in any suitable location about the wellhead assembly 18. For example, the sensing elements 50 may be disposed on one or more of the strings 28, disposed in one or more annuli 34, and/or disposed in the wellhead 26. Further, in some embodiments, one or more of the sensing elements 50 may be disposed in (e.g., set in or fixed in) the cement 32. For example, the sensing elements 50 may be mixed with a cement slurry and pumped into at least one of the annuli 34 of the wellhead assembly 18. As the cement slurry hardens, the sensing elements 50 may be set or fixed into place in the hardened cement 32. In some embodiments, one or more of the sensing elements 50 may be disposed in the wellbore 30 (e.g., below the surface 24). Further, the well integrity monitoring system 10 may include any suitable number of sensing elements 50, such as 1, 2, 3, 4, 5, 10, 25, 50, 75, 100, or more.

In some embodiments, the sensing elements 50 may include one or more electronic sensor modules 52 (e.g., electronic sensor units, microsensors, etc.) configured to measure one or more well integrity parameters. For example, as discussed below, each electronic sensor module (ESM) 52 may include one or more sensors, such as temperature sensors, pressure sensors (e.g., piezoelectric sensors, capacitive sensors, strain gauges, load cells, potentiometers, etc.), acoustic sensors, optical sensors, flow sensors (e.g., flow meters), motion sensors (e.g., vibration sensors, seismic sensors, accelerometers, gyroscopes, etc.), position sensors (e.g., inclinometers), fluid detectors (e.g., gas detectors, hydrocarbon detectors, etc.), and so forth. The ESMs 52 may generate signals (e.g., sensor signals, sensor feedback, etc.) indicative of measured well integrity parameters.

In certain embodiments, the sensing elements 50 may include one or more cement additives 54 (e.g., temperature-sensitive cement additives, hydrocarbon-sensitive cement additives, etc.). The cement additives 54 may be mixed with the cement slurry and may be disposed throughout the hardened cement 32. The cement additives 54 may generate sensor feedback (e.g., a change in a parameter of the cement additives 54) indicative of detected or sensed well integrity parameters (e.g., cement integrity parameters). For example, a parameter of the cement additive 54, such as conductivity, magnetism, or color may be configured to change when the cement additive 54 is exposed to fluids (e.g., hydrocarbons, oil, gas, etc.) and/or a particular temperature.

Further, the well integrity monitoring system 10 may include one or more sensor controllers 56 (e.g., sensor control modules, wellhead monitoring packages, processor-based controllers, electronic control units, etc.). The one or more sensor controllers 56 may be configured to wirelessly determine the sensor feedback from the sensing elements 50. For example, the sensor controllers 56 may wirelessly receive signals from the ESMs 52 and/or may wirelessly detect a change in a parameter of the cement additives 54. While the embodiment of the well integrity monitoring system 10 shown in FIG. 1 includes one sensor controller 56, it should be appreciated that the well integrity monitoring system 10 may include 2, 3, 4, 5, 10, or more sensor controllers 56. Further, each sensor controller 56 may be configured to wirelessly determine sensor feedback from any suitable number of sensing elements 50, such as 1, 2, 3, 4, 5, 10, or more sensing elements 50.

As illustrated, in some embodiments, the sensor controller 56 may be disposed on (e.g., coupled to, fastened to, or clamped to) an outer surface 58 (e.g., an outer annular surface, an outer diameter portion, etc.) of an outermost string 60 (e.g., a conductor, a conductor pipe) of the plurality of strings 28. In some embodiments, the sensor controller 56 may be annular and coaxial with the plurality of strings 28. In some embodiments, the sensor controller 56 may be disposed in the wellbore 30. Further, in some embodiments, the sensor controller 56 may be partially or fully disposed in (e.g., surrounded by, encapsulated in) the cement 32. In certain embodiments, the sensor controllers 56 may be disposed in or on the wellhead 26 or in any other suitable location of the wellhead assembly 18.

The sensor controller 56 may wirelessly determine the sensor feedback from the sensing elements 50 and may transmit the determined sensor feedback to the controller 48. In some embodiments, the sensor controller 56 may transmit the sensor feedback directly to the controller 48 wirelessly or via one or more wired connections (e.g., wire lines, cables, umbilicals, etc.). In certain embodiments, the sensor controller 56 may transmit the sensor feedback to a subsea controller 62 (e.g., a subsea control module, a wellhead controller, a processor-based controller, an electronic control unit, etc.) wirelessly or via one or more wired connections. The subsea controller 62 may transmit the sensor feedback to the controller 48 wirelessly or via one or more wired connections. The subsea controller 62 may be disposed in or on the BOP assembly 40 (e.g., the LMRP 44 and/or the BOP 42), the wellhead assembly 18 (e.g., the wellhead 26), a Christmas tree, or any other suitable component of the mineral extraction system 8 that is located below the first surface 14. As illustrated, in some embodiments, the subsea controller 62 may be coupled to the controller 48 via an umbilical 64. The umbilical 64 may include one or more lines (e.g., hydraulic, optical, and/or electrical lines) to transmit power, control signals, and/or data (e.g., sensor feedback).

Figure 2:
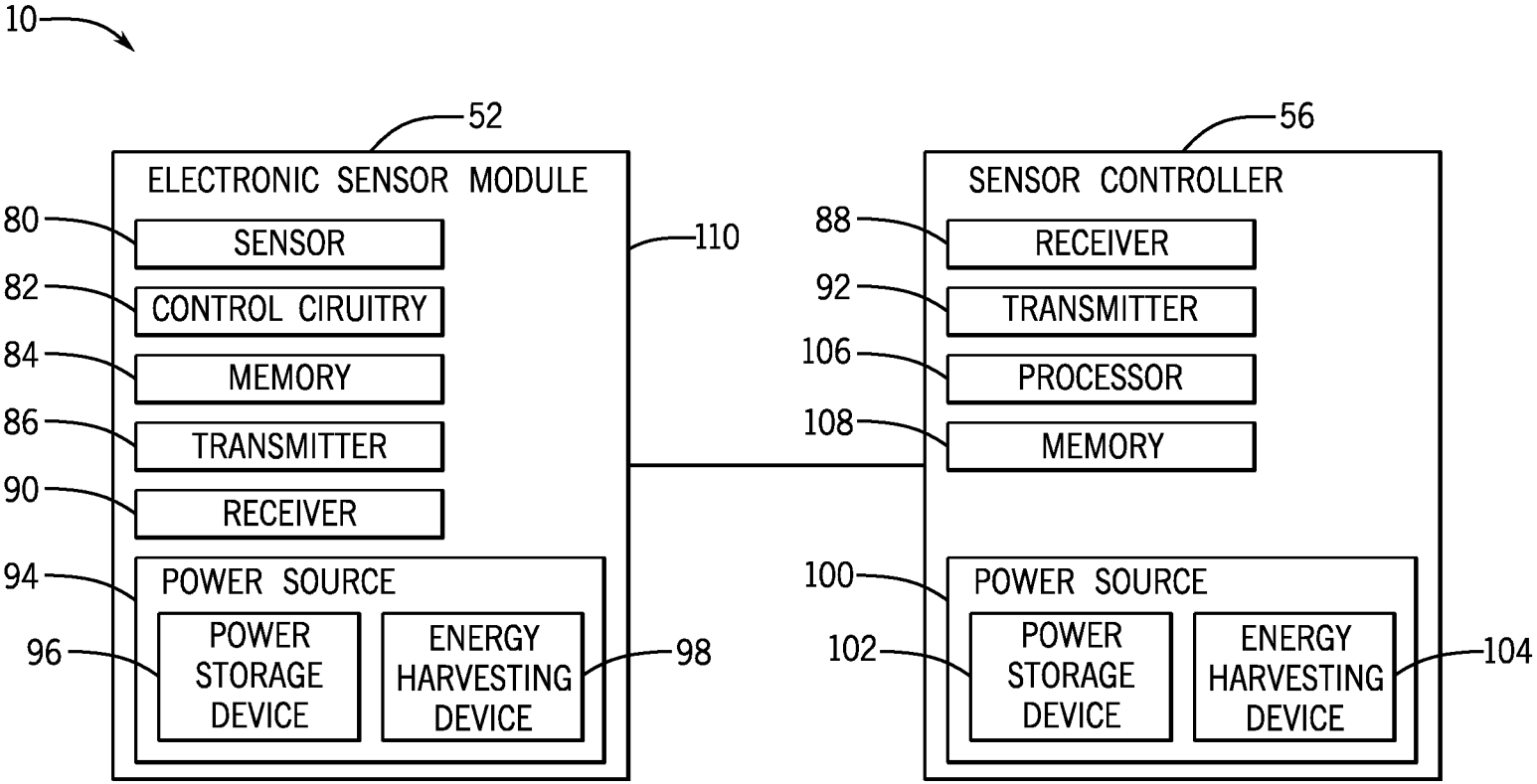
FIG. 2 is a block diagram of an embodiment of the well integrity monitoring system of FIG. 1 including a sensor controller and an electronic sensor module.

FIG. 2 illustrates a block diagram of an embodiment of the well integrity monitoring system 10 including a plurality of the ESMs 52 and the sensor controller 56. In the embodiment illustrated in FIG. 2, the well integrity monitoring system 10 includes one sensor controller 56 that is wirelessly communicatively coupled to each ESM 52 of the plurality of ESMs 52. In certain embodiments, the well integrity monitoring system 10 may include two or more sensor controllers 56, and each sensor controller 56 of the two or more sensor controllers 56 may be wirelessly communicatively coupled to one or more ESMs 52 of the plurality of ESMs 52. Further, in the embodiment illustrated in FIG. 2, each ESM 52 of the plurality of ESMs 52 includes the same components. In some embodiments, two or more ESMs 52 of the plurality of ESMs 52 may include different components.

As illustrated in FIG. 2, each ESM 52 may include one or more sensors 80 configured to detect or measure one or more well integrity parameters and to generate signals (e.g., sensor signals, sensor feedback) based on the detected or measured well integrity parameters. For example, the one or more sensors 80 may measure pressure and/or temperature of fluid within one or more annuli 34. In some embodiments, one or more sensors 80 may measure parameters indicative of a structural integrity of one or more strings 28 and/or the wellhead 26, such as the stress, strain, bending (e.g., inclination), and/or lateral displacement of the strings 28 and/or the wellhead 26. Further, in some embodiments, one or more sensors 80 (e.g., disposed in or adjacent to the cement 32) may be configured to measure the temperature of the cement 32 and/or may detect the presence of oil, gas, hydrocarbons, or other fluids in the cement 32. In some embodiments, one or more sensors 80 (e.g., disposed in or adjacent to the cement 32) may be configured to measure an amount or a flow rate of oil, gas, hydrocarbons, or other fluids in or through the cement 32. In some embodiments, each sensor 80 of the one or more sensors 80 may be configured to measure a different well integrity parameter. In certain embodiments, the one or more sensors 80 may include temperature sensors, pressure sensors (e.g., piezoelectric sensors, capacitive sensors, strain gauges, load cells, potentiometers, etc.), acoustic sensors, optical sensors, flow sensors (e.g., flow meters), motion sensors (e.g., vibration sensors, seismic sensors, accelerometers, gyroscopes, etc.), position sensors (e.g., inclinometers), fluid detectors (e.g., gas detectors, hydrocarbon detectors, etc.), and so forth. Further, in some embodiments, two or more ESMs 52 of the plurality of ESMs 52 may include different types of sensors 80 and/or different numbers of sensors 80. For example, one ESM 52 may include a temperature sensor, and another ESM 52 may include a pressure sensor.

In some embodiments, one or more ESMs 52 of the plurality of ESMs 52 may include control circuitry 82 and a memory 84. The memory 84 may store instructions, which may be accessed and executed by the control circuitry 82 to perform specific operations, such as the methods and processes of the embodiments described herein. In certain embodiments, the control circuitry 82 may include one or more microprocessors, microcontrollers, integrated circuits, and/or application specific integrated circuits. In some embodiments, the memory 84 may be combined with or integral with the control circuitry 82 (e.g., one or more integrated circuits and/or application specific integrated circuits). The control circuitry 82 may be configured to control the operation of the one or more sensors 80 (e.g., the data acquisition). For example, the control circuitry 82 may cause the one or more sensors 80 to acquire data (e.g., generate sensor signals) at predetermined intervals, continuously, and/or in response to a signal received from the sensor controller 56. In certain embodiments, the control circuitry 82 may cause the one or more sensors 80 to acquire data at a higher rate in response to an event of the wellhead assembly 18 detected by one or more of the ESMs 52, such as a seismic event detected by a seismic sensor 80.

In some embodiments, the control circuitry 82 may be configured to process (e.g., filter, amplify, digitize, compress, etc.) the signals generated by the one or more sensors 80. For example, the control circuitry 82 may process raw analog signals generated by the sensor 80 to generate processed analog sensor signals and/or digital sensor signals. In certain embodiments, the control circuitry 82 may be configured to measure or determine values of one or more well integrity parameters based on the sensor signals. It should be appreciated that sensor feedback generated by the ESM 52 may include analog sensor signals, raw or unprocessed sensor signals, processed sensor signals, digital sensor signals, measured or determined values of well integrity parameters, or any combination thereof.

Further, in some embodiments, the control circuitry 82 may be configured to generate sensor feedback based on an analysis of the sensor signals and/or the determined values of the well integrity parameters. For example, the control circuitry 82 may compare the determined value of a well integrity parameter (e.g., temperature, an amount of hydrocarbons, etc.) or a characteristic of a sensor signal (e.g., an amplitude, a frequency, a period, or a wavelength) to a respective threshold (e.g., upper and/or lower thresholds stored in the memory 84 and may generate sensor feedback that indicates whether the determined value of the well integrity parameter or the characteristic of the sensor signal violates (e.g., is greater than or less than) the respective threshold or is between upper and lower thresholds. In some embodiments, the control circuitry 82 may generate a signal having a first frequency or wavelength in response to a determination that the determined value or the characteristic violates the respective threshold, and the control circuitry 82 may generate a signal having a second frequency or wavelength different from the first frequency or wavelength, respectively, in response to a determination that the determined value or the characteristic does not violate the respective threshold.

In some embodiments, the control circuitry 82 may generate sensor feedback indicative of the difference between the determined value or the characteristic and the respective threshold. Further, in some embodiments, the control circuitry 82 may generate sensor feedback indicative of a number of times and/or a duration of time that a well integrity parameter or a characteristic of a sensor signal violated a respective threshold. In some embodiments, the control circuitry 82 may calculate an integral of the amount of time and the amount (e.g., the extent) by which the determined value or the characteristic violated the respective threshold and may generate sensor feedback indicative of the calculated integral.

As noted above, one or more ESMs 52 of the plurality of ESMs 52 may include the memory 84. In some embodiments, the memory 84 may be configured to store the sensor feedback. In certain embodiments, the memory 84 may be configured to store information indicative of a location of the respective ESM 52 in the wellhead assembly 18, such as information that indicates which annulus 34 the ESM 52 is disposed in, which string 28 that ESM 52 is disposed on, or indicates that the ESM 52 is disposed in the cement 32. In some embodiments, the control circuitry 82 may be configured to compress the sensor feedback (e.g., sensor signals) before storing the sensor feedback in the memory 84. Further, as noted above, the memory 84 may be configured to store one or more thresholds (e.g., upper and/or lower thresholds) for one or more well integrity parameters.

Each ESM 52 may also include a transmitter 86 (e.g., a wireless transmitter) configured to wirelessly transmit the sensor feedback to at least one receiver 88 (e.g., a wireless receiver) of the sensor controller 56. In some embodiments, one or more ESMs 52 of the plurality of ESMs 52 may include a receiver 90 configured to wirelessly receive signals (e.g., control signals, data signals, etc.) from at least one transmitter 92 of the sensor controller 56. In some embodiments, the transmitters 86 and 92 may be configured to transmit inductive signals, electromagnetic radiation (EM) signals (e.g., radio-frequency (RF) signals), acoustic signals, or any other suitable wireless signal. For example, the transmitters 86 and 92 may each include an inductive element (e.g., an inductive coil), an antenna, an acoustic transducer, and so forth. The receivers 88 and 90 may be configured to receive inductive signals, EM signals (e.g., RF signals), acoustic signals, or any other wireless signal transmitted by the transmitter 86 or the transmitter 92, respectively. The transmitters 86 and 92 and the receivers 88 and 90 may be configured to wirelessly communicate through the strings 28 (e.g., steel pipes) and/or through the cement 32.

Further, the control circuitry 82 may be configured to control the wireless transmission of the sensor feedback. For example, in some embodiments, the control circuitry 82 may cause the transmitter 86 to transmit sensor feedback to the receiver 88 at predetermined intervals and/or in response to a signal (e.g., an interrogation signal) received from the sensor controller 56. In some embodiments, the control circuitry 82 may cause the transmitter 86 to transmit sensor feedback to the receiver 88 in response to a determination that a determined value of a well integrity parameter (e.g., temperature, an amount of hydrocarbons, etc.) and/or a characteristic of a sensor signal violates a respective threshold. In some embodiments, the control circuitry 82 may cause the transmitter 86 to transmit sensor feedback to the receiver 88 in response detection of hydrocarbons and/or oil by a sensor 80 (e.g., a gas detector or a hydrocarbon detector) of the ESM 52. Further, the control circuitry 82 may cause the transmitter 86 to transmit a signal to the sensor controller 56 that is indicative of a location of the respective ESM 52 in the wellhead assembly 18. Providing the location of the ESM 52 to the sensor controller 56 may be desirable in embodiments in which the sensor controller 56 wirelessly communicates with more than one ESM 52.

In some embodiments, one or more ESMs 52 of the plurality of ESMS 52 may include a power source 94 configured to power the components of the respective ESM 52. In certain embodiments, the power source 94 may include a power storage device 96, such as a one or more of battery, a rechargeable battery, a capacitor, an ultracapacitor, or any other suitable device configured to store power. In some embodiments, the power source 94 may include one or more energy harvesting devices 98, such as piezoelectric sensors, microelectromechanical systems (MEMS), a thermoelectric generator, or any other suitable device configured to harvest kinetic and/or thermal energy. The ESM 52 may include circuitry for converting the harvested kinetic and/or thermal energy into power (e.g., voltage and/or current). Further, in some embodiments, the receiver 90 and/or the power source 94 may be configured to wirelessly receive energy (e.g., inductive energy) from the sensor controller 56 (e.g., from the transmitter 92 of the sensor controller 56), and the ESM 52 may include circuitry for converting the inductive energy into power. In some embodiments, the sensor controller 56 may be configured to generate pressure pulses and/or acoustic signals to the power source 94, which may be harvested by one or more energy harvesting devices 98. In some embodiments, the power storage device 96 may be configured to store the converted power for later use. In certain embodiments, the ESM 52 may be configured to use the converted power to directly power the components of the ESM 52. As noted above, two or more ESMs 52 of the plurality of ESMs 52 may include different components. For example, an ESM 52 may include the receiver 90 and may not include the power source 94, and the EMC 52 may be configured to operate only when the ESM 52 wirelessly receives power from the sensor controller 56.

In some embodiments, the sensor controller 56 may include a power source 100 configured to power components of the sensor controller 56. For example, the power source 100 may include a power storage device 102 (e.g., a battery, a rechargeable battery, a capacitor, an ultracapacitor, etc.) and/or one or more energy harvesting devices 104 (e.g., piezoelectric sensors, microelectromechanical systems (MEMS), a thermoelectric generator, etc.) configured to harvest kinetic and/or thermal energy. Further, in some embodiments, the transmitter 92 and/or the power source 100 of the sensor controller 56 may be configured to wirelessly transmit the inductive energy to the receiver 90 and/or the power source 94 of one or more ESMs 52 of the plurality of ESMs 52. In some embodiments, the sensor controller 56 may be configured to receive power from the subsea controller 62, the controller 48, or any other suitable device (e.g., an autonomous underwater vehicle (AUV) or a remotely operated vehicle (ROV)) via a wired connection and/or a wireless connection.

Additionally, the sensor controller 56 may include a processor 106 and memory 108. The memory 108 may be configured to store instructions, which may be accessed and executed by the processor 106 to perform specific operations, such as the methods and processes of the embodiments described herein. The processor 106 may be configured to control operation of the receiver 88, the transmitter 92, and the power source 100 of the sensor controller 56. Additionally, the processor 106 may be configured to control one or more operations of the ESMs 52. For example, the processor 106 may control the transmitter 92 to transmit a signal to an ESM 52 that causes the one or more sensors 80 of the ESM 52 to acquire data. Additionally, the processor 106 may control the transmitter 92 to transmit a signal to an ESM 52 that causes the transmitter 86 of the ESM 52 to transmit data (e.g., sensor feedback) to the receiver 88 of the sensor controller 56. Further, the processor 106 may control the transmitter 92 to transmit a control signal to an ESM 52 that instructs the control circuitry 82 of the ESM 52 to perform any of the operations and processes discussed above.

Further, the processor 106 may be configured to perform any of the operations of the control circuitry 82 described above for processing and/or analyzing sensor signals and/or determined values of well integrity parameters based on the sensor signals. For example, the processor 106 may process (e.g., amplify, filter, digitize, compress, etc.) raw sensor signals received from the ESMs 52. Additionally, the processor 106 may determine values of well integrity parameters based on the raw or processed sensor signals received from the ESMs 52. Further, the processor 106 may be configured to analyze the sensor signals and/or the determined values of the well integrity parameters as discussed above with respect to the control circuitry 82 to generate sensor feedback (e.g., signals indicative of whether the sensor signals or determined values violated a respective threshold, signals indicative of a number of times the sensor signals or determined values violated a respective threshold, etc.). Additionally, the memory 108 of the sensor controller 56 may be configured to store the sensor feedback received from the ESMs 52, the sensor feedback generated by the processor 106, baseline data, historical data, thresholds, alerts, alarms, etc.

In some embodiments, the memory 108 of the sensor controller 56 and/or the memory 84 may be configured to store one or more operational modes, where each operational mode is associated with a different rate of data acquisition and/or a different rate of data transmission. For example, one or more ESMs 52 may be configured to generate sensor feedback at a particular rate specified by an operating mode and/or to transmit the sensor feedback to the sensor controller 56 at a particular rate specified by an operating mode. In some embodiments, the control circuitry 82 and/or the processor 106 may be configured to select an operating mode from a plurality of operating modes stored in the memory 84 or the memory 108, respectively, and may be configured to control operation of one or more ESMs 52 based on the selected operating mode. In some embodiments, one or more operating modes of the plurality of operating modes may be associated with a stage of the life of the well 20. For example, the plurality of operating modes may include a first operating mode associated with drilling of the well 20, a second operating mode associated with completion of the well 20, a third operating mode associated with production of the well 20, and/or a further operating mode(s) associated with abandonment of or injection from the well 20. In certain embodiments, the sensor controller 56 may be configure to select an operating mode from the plurality of operating modes based on a signal received from a controller (e.g., the controller 48), which may indicate a stage of the life of the well 20 (e.g., drilling, completion, production, injection or abandonment).

In some embodiments, one or more ESMs 52 of the plurality of ESMs 52 may be manufactured using a single sensor package 110 (e.g., a single sensor chip). That is, in some embodiments, all of the components of an ESM 52 (e.g. the one or more sensors 80, the control circuitry 82, the memory 84, the transmitter 86, the receiver 90, the power source 94, the power storage device 96, and/or the energy harvesting device 98) may be mounted on or integrated on the single sensor package 110. As noted above, two or more ESMs 52 of the plurality of ESMs 52 may include different components. Accordingly, in some embodiments, the components mounted on or integrated on the single sensor package 100 for two or more ESMs 52 may be different. Additionally, in some embodiments, one or more ESMs 52 of the plurality of ESMs 52 may be microsensors or microelectronic sensor modules (MESMs). For example, at least one dimension (e.g., length, width, and/or thickness) of the MESM 52 (e.g., at least one dimension of the single sensor package 110) may be less than or equal to approximately thirty millimeters (mm), twenty mm, fifteen mm, or ten mm. Further, one or more ESMs 52 of the plurality of ESMs 52 may be annular, planar, oval, round, or any other suitable shape. Additionally, one or more of the ESMs 52 of the plurality of ESMs 52 may include a sensor housing configured to contain the components of the respective ESM 52 (e.g., the single sensor package 100), and the sensor housing may be sealed, pressure balanced with the environment, or filled with an inert gas (e.g., nitrogen) or fluid.

Figure 3:
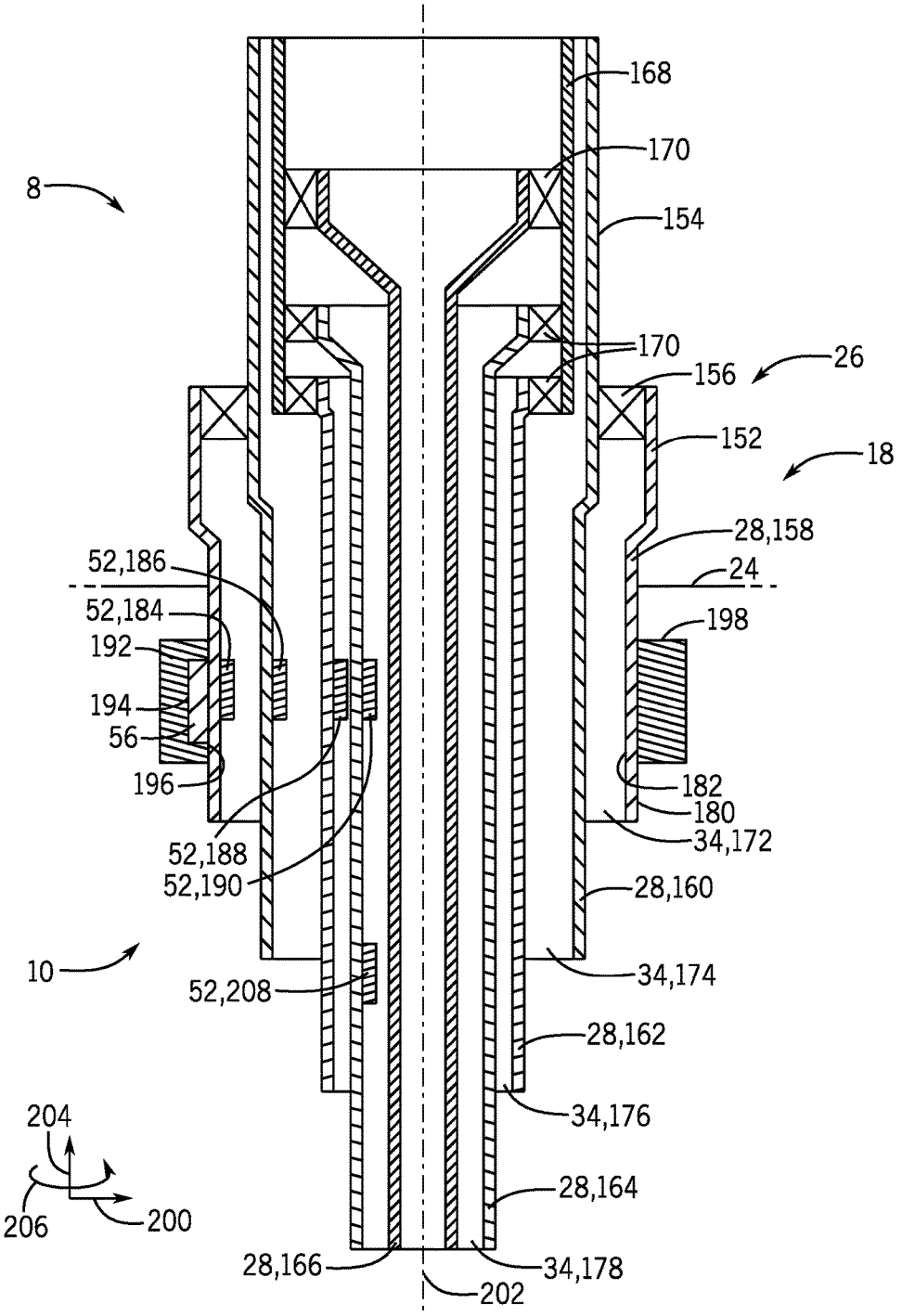
FIG. 3 is a cross-sectional view of an embodiment of the mineral extraction system of FIG. 1, illustrating a sensor controller and electronic sensor modules coupled to the wellhead assembly.

FIG. 3 is a cross-sectional view of an embodiment of the wellhead assembly 18 including the sensor controller 56 and the ESMs 52. As noted above, the wellhead assembly 18 may include the wellhead 26 and the plurality of strings 28 that extend from the wellhead 26 into the well 20. As illustrated, the wellhead 26 of the wellhead assembly 18 may include a low pressure wellhead housing 152 (e.g., an outer annular wellhead housing) and a high pressure wellhead housing 154 (e.g., an inner annular wellhead housing). The low pressure wellhead housing 152 may be coupled to the high pressure wellhead housing 154 via a packer 156 (e.g., an annular seal).

In some embodiments, the plurality of strings 28 may include a conductor pipe 158, a surface casing 160, an intermediate casing 162, a production casing 164, and a production tubing 166. The conductor pipe 158 may be coupled to the low pressure wellhead housing 152, and the surface casing 160 may be coupled to the high pressure wellhead housing 154. In some embodiments, the intermediate casing 162, the production casing 164, and the production tubing 166 may each be coupled to an inner annular surface 168 (e.g., an annular bore) of the high pressure wellhead housing 154 via one or more packers 170.

As illustrated, the surface casing 160 may extend through the conductor pipe 158, and a first annulus 172 may be formed between the surface casing 160 and the conductor pipe 158. Additionally, the intermediate casing 162 may extend through the surface casing 160, and a second annulus 174 may be formed between the intermediate casing 162 and the surface casing 160. Further, the production casing 164 may extend through the intermediate casing 162, and a third annulus 176 may be formed between the production casing 164. Additionally, the production tubing 166 may extend through the production casing 164, and a fourth annulus 178 may be formed between the production tubing 166 and the production casing 164.

In some embodiments, the well integrity monitoring system 10 may include at least one ESM 52 coupled to or integral with the conductor pipe 158, the surface casing 160, the intermediate casing 162, the production casing 164, the production tubing 166, or any combination thereof. Additionally, the ESMs 52 may be coupled to or integral with inner surfaces 180 and/or outer surfaces 182 of the conductor pipe 158, the surface casing 160, the intermediate casing 162, the production casing 164, and the production tubing 166. Further, in some embodiments, one or more ESMs 52 may be coupled to a string 28 at the first surface 14 (e.g., the sea surface) and may be installed in the well 20 with the string 28.

As illustrated, in some embodiments, the well integrity monitoring system 10 may include a first ESM 184 coupled to the conductor pipe 158 and disposed in the first annulus 172, a second ESM 186 coupled to the surface casing 160 and disposed in the second annulus 174, a third ESM 188 coupled to the intermediate casing 162 and disposed in the third annulus 176, and a fourth ESM 190 coupled to the production casing 164 and disposed in the fourth annulus 178. In certain embodiments, the first, second, third, and fourth ESMs 184, 186, 188, and 190 may be configured to generate sensor feedback relating to the pressure and/or temperature of fluid within the first annulus 172, the second annulus 174, the third annulus 176, and the fourth annulus 178, respectively. In some embodiments, the first, second, third, and fourth ESMs 184, 186, 188, and 190 may be configured to generate sensor feedback relating to the stress, strain, bending, inclination, or any other parameter disclosed herein of the conductor pipe 158, the surface casing 160, the intermediate casing 162, and the production casing 164, respectively.

Further, as illustrated, the sensor controller 56 may be coupled to the outer surface 180 of the conductor pipe 158. Accordingly, the sensor controller 56 may be configured to wirelessly receive the sensor feedback from, and to wirelessly transmit power and control signals to, the first, second, third, and fourth ESMs 184, 186, 188, and 190 through one or more of the conductor pipe 158, the surface casing 160, the intermediate casing 162, and the production casing 164. In some embodiments, the sensor controller 56 may be located below the second surface 24 (e.g., the sea floor). In certain embodiments, the sensor controller 56 may be coupled to the outer surface 180 of the conductor pipe 158 at the first surface 14 (e.g., the sea surface) and may be installed in the well 20 with the conductor pipe 158.

In some embodiments, the sensor controller 56 may be coupled to the outer surface 180 of the conductor pipe 158 via a clamp connector 192 configured to couple to (e.g., at least partially surround) the outer surface 180 of the conductor pipe 158. For example, in some embodiments, the clamp connector 192 may include a recess 194 (e.g., an insert) formed in an inner surface 196 (e.g., an inner annular surface) of the clamp connector 192 that is configured to abut the outer surface 180 of the conductor pipe 158. The sensor controller 56 may be inserted in the recess 194 and may be secured between the outer surface 180 of the conductor pipe 158 and the clamp connector 192 when the clamp connector 192 is coupled to the conductor pipe 158. In some embodiments, the sensor controller 56 in the recess 194 may abut the outer surface 180 of the conductor pipe 158 when the clamp connector 192 is coupled to the conductor pipe 158. In certain embodiments, the sensor controller 56 may be disposed in (e.g., integral with) the clamp connector 192. In some embodiments, the sensor controller 56 may be coupled to an outer surface 198 of the clamp connector 192 (e.g., a surface that does not abut the conductor pipe 158 when the clamp connector 192 is coupled to the conductor pipe 158). Further, in some embodiments, two or more sensor controllers 56 may be coupled to the clamp connector 192. In certain embodiments, two or more clamp connectors 192, which may each be coupled to one or more sensor controllers 56, may be coupled to the conductor pipe 158.

It should appreciated that the sensor controller 56 may be disposed in any suitable location about the wellhead assembly 18. For example, in some embodiments, the clamp connector 192 having the sensor controller 56 may be disposed about the wellhead 26 (e.g., the low pressure wellhead housing 152 or the high pressure wellhead housing 154). Further, in some embodiments, the sensor controller 56 may be disposed in a recess (e.g., a machined recess or interface) formed in any suitable location about the strings 28 and/or about the wellhead 26. Similarly, in some embodiments, one or more of the ESMs 52 may be disposed in a recess (e.g., a machined recess or interface) formed in any suitable location about the strings 28 and/or the wellhead 26.

In some embodiments, the sensor controller 56 may be removable from the clamp connector 192 (e.g., from the recess 194 and/or the outer surface 198). As such, the sensor controller 56 may be configured to couple to different types of clamp connectors 192 and/or clamp connectors 192 having differently sized inner diameters, which may enable the sensor controller 56 to be coupled to different strings 28 and/or strings 28 having differently sized outer diameters. Further, in some embodiments, the clamp connector 192 having the sensor controller 56 may be coupled to the conductor pipe 158 at the first surface 14, and the conductor pipe 158 with the clamp connector 192 may be installed in the well 20. In certain embodiments, the clamp connector 192 and the sensor controller 56 may be installed below the first surface 14 by a diver, a remotely operated underwater vehicle (ROV), or an autonomous underwater vehicle (AUV).

As illustrated, in some embodiments, the sensor controller 56 and the first, second, third, and fourth ESMs 184, 186, 188, and 190 may be generally aligned with respect to one another in a radial direction 200 relative to a longitudinal axis 202 of the wellhead assembly 18. However, it should be appreciated the sensor controller 56 and the ESMs 52 of the well integrity monitoring system 10 may be disposed in any suitable arrangement. For example, the sensor controller 56 may be aligned and/or misaligned (e.g., staggered arrangement) with one or more of the ESMs 52 in the radial direction 200, in an axial direction 204 along the longitudinal axis 202, and/or in a circumferential direction 206 about the longitudinal axis 202. Additionally, two or more ESMs 52 of the well integrity monitoring system 10 may be aligned and/or misaligned with one another 52 in the radial direction 200, in the axial direction 204, and/or in the circumferential direction 206. For example, the well integrity monitoring system 10 may include a fifth ESM 208 that is generally aligned with the fourth ESM 190 in the axial direction 200 and misaligned with the first, second, third, and fourth ESMs 184, 186, 188, and 190 in the radial direction 204. Further, in some embodiments, the outer surface 180 and/or the inner surface 182 of one of the strings 28 may include two or more ESMs 52 that are spaced apart from one another in the circumferential direction 206.

As noted above, the well integrity monitoring system 10 may be configured to monitor the integrity of the well 20 during drilling of the well 20, completion of the well 20, production of the well 20, and/or abandonment of the well 20. Further, as noted above, the well integrity monitoring system 10 may be configured to monitor the well 20 differently for each stage, such as, for example, using a drilling operating mode, a completion operating mode, a production operating mode, and an abandonment operating mode. For example, the wellhead 26 (e.g., the high pressure wellhead housing 154) may be coupled to the BOP assembly 40 including the subsea control module 62 as illustrated in FIG. 1 during drilling and completion of the well 20. As discussed above with respect to FIG. 1, the sensor controller 56 may be communicatively coupled to the subsea control module 62 wirelessly or via a wired connection, and the subsea control module 62 may be communicatively coupled to the controller 48 wirelessly or via a wired connection. Accordingly, the sensor controller 56 may transmit sensor feedback generated during drilling and completion of the well 20 to the subsea control module 62, which may transmit the sensor feedback to the controller 48. In some embodiments, the subsea control module 62 may be configured to transmit power and/or control signals to the sensor controller 56.

Figure 4:
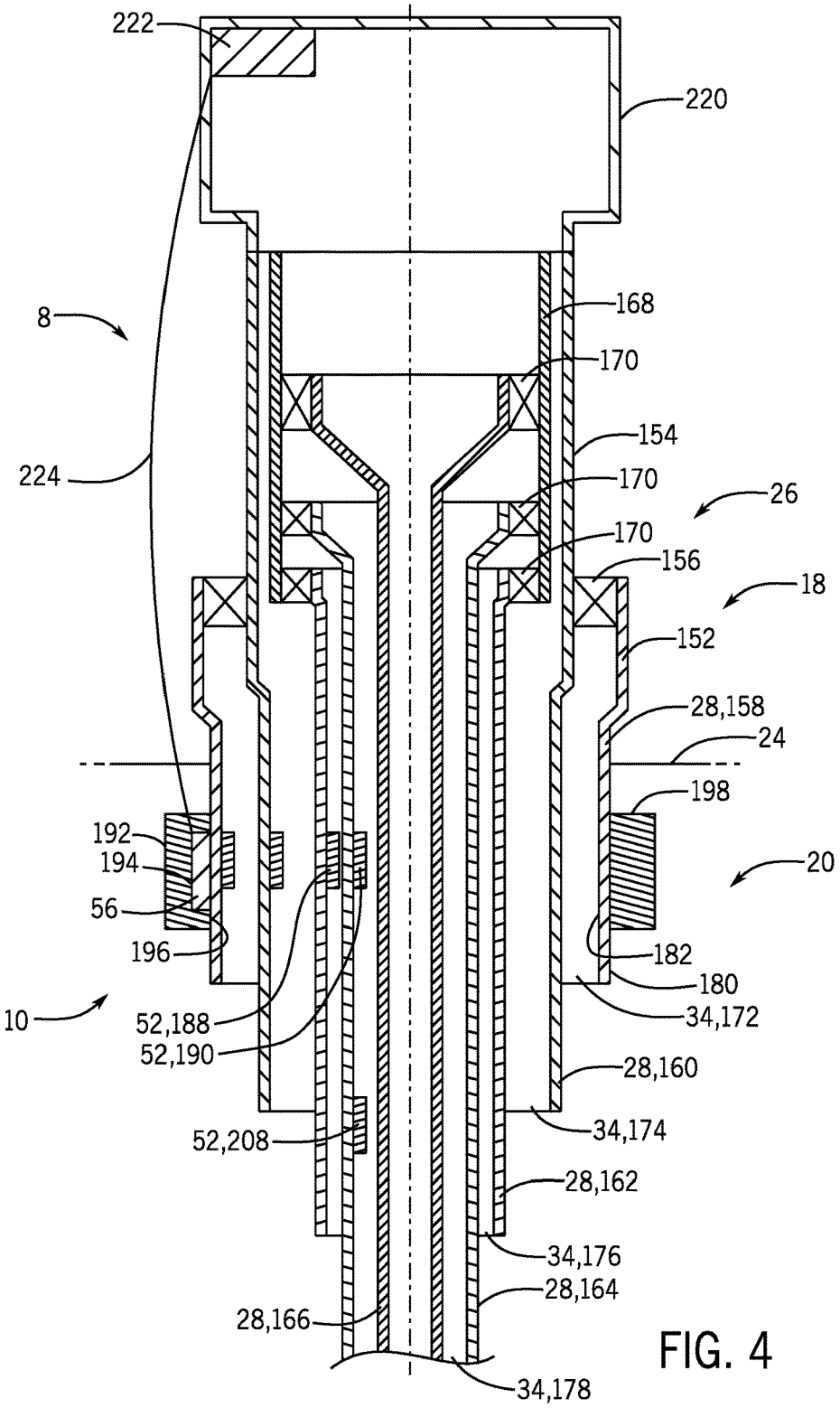
FIG. 4 is a cross-sectional view of an embodiment of the mineral extraction system of FIG. 1, where the well integrity monitoring system is configured to monitor integrity of a well during production of the well.

FIG. 4 illustrates an embodiment of the wellhead assembly 18 and the well integrity monitoring system 10 during production of the well 20. In particular, the wellhead assembly 18 may be coupled to a Christmas tree 220 (e.g., a production or injection tree) during production and/or injection of the well 20. For example, the BOP assembly 40 may be removed from the wellhead 26 (e.g., the high pressure wellhead housing 154) once the well 20 is completed, and subsequently, the Christmas tree 220 may be coupled to the wellhead 26 to enable production of the well 20. In some embodiments, the Christmas tree 220 may include a subsea control module 222, which may be communicatively coupled to the sensor controller 56 wirelessly or via a wired connection 224. Accordingly, the sensor controller 56 may transmit sensor feedback generated during production of the well 20 to the subsea control module 222, which may transmit the sensor feedback to the controller 48 wirelessly or via a wired connection. Further, in some embodiments, the subsea control module 222 may be configured to transmit power and/or control signals to the sensor controller 56.

Figure 5:
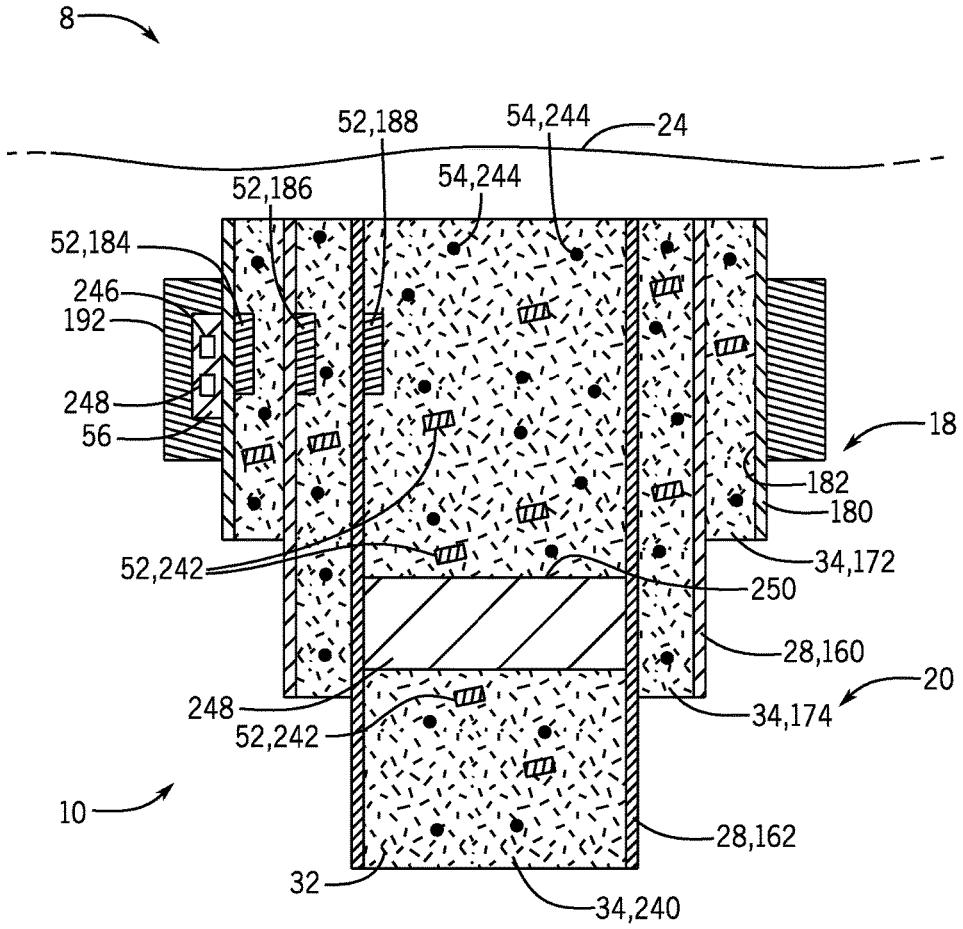
FIG. 5 is a cross-sectional view of an embodiment of the mineral extraction system of FIG. 1, where the well integrity monitoring system is configured to monitor integrity of a well during abandonment of the well.

FIG. 5 illustrates an embodiment of the wellhead assembly 18 and the well integrity monitoring system 10 during abandonment of the well 20. As illustrated, the wellhead assembly 18 may be cut below the second surface 24 (e.g., sea floor) to abandon the well 20 such that no components of the wellhead assembly 18 extend to or past the second surface 24. Additionally, in some embodiments, the production tubing 166 and the production casing 164 may be removed from the wellhead assembly 18. To prevent or block the unintentional flow of fluids through the wellhead assembly 18 to the second surface 24, cement 32 may be circulated through the first annulus 172, the second annulus 174, and an annulus 240 of the intermediate casing 162. As illustrated, the first, second, and third ESMs 184, 186, and 188 may be left in place on the conductor pipe 158, the surface casing 160, and the intermediate casing 162, respectively, during abandonment of the well 20. In some embodiments, the cement 32 may surround the first, second, and/or third ESMs 184, 186, and 188. Further, in some embodiments, one or more additional ESMs 242 may be circulated through the first annulus 172, the second annulus 174, and/or the annulus 240 with the cement 32. Additionally, the sensor controller 56 may be left in place on the conductor pipe 158 during abandonment of the well 20. As such, the first, second, and third ESMs 184, 186, and 188, as well as the additional ESMs 244, may generate sensor feedback during abandonment of the well 20 and may wirelessly transmit the sensor feedback to the sensor controller 56. In some embodiments, the sensor controller 56 may wirelessly transmit the sensor feedback to the controller 48 (or another processor-based device), which may be located at the first surface 14.

Additionally, in some embodiments, the cement additives 54 (e.g., temperature-sensitive cement additives, hydrocarbon-sensitive cement additives, etc.) may be mixed with the cement slurry and circulated with the cement 32 through the first annulus 172, the second annulus 174, and/or the annulus 240. For example, the cement additives 54 may include a plurality of magnetic particles 244 (e.g., ferromagnetic particles). The plurality of magnetic particles 244 may be made from iron, nickel, cobalt, or any other suitable magnetic material. The sensor controller 56 may be configured to apply a magnetic field to the plurality of magnetic particles 244. For example, the sensor controller 56 may include a current conductor 246 (e.g., a wire) configured to carry a current, and the sensor controller 56 may be configured to apply a current to the current conductor to generate a magnetic field. In some embodiments, the conductor pipe 158 may be configured to carry a current, and the sensor controller 56 may be configured to apply a current to the conductor pipe 158 to generate a magnetic field. The magnetic field applied to the plurality of magnetic particles 244 may magnetize the plurality of magnetic particles 244. In some embodiments, the magnetization of the plurality of magnetic particles 244 may vary with temperature. For example, the magnetization of the plurality of magnetic particles 244 may decrease with increases in temperature.

Accordingly, the sensor controller 56 may also include a magnetic field sensor 248 configured to detect a magnetic field. Specifically, the magnetic field sensor 248 may be configured to generate an output (e.g., a signal, an electrical output, a voltage, etc.) that varies based on the magnitude of the detected magnetic field. For example, the magnetic field sensor 248 may include a Hall effect sensor, a magnetodiode, a magneto-transistor, a microelectromechanical (MEMS) magnetic field sensor, or any other suitable sensor configured to measure a magnetic field. Thus, the magnetic field sensor 248 may detect changes in the magnitude of the magnetic field caused by a change in the magnetization of the plurality of magnetic particles 244 that is indicative of a change in temperature of the cement 32. In other words, the magnetic field sensor 248 may wirelessly detect or receive the sensor feedback generated by the plurality of magnetic particles 244 (e.g., the change in magnetization) that is indicative of the integrity of the cement 32. Additionally, the sensor controller 56 may be configured to transmit the output of the magnetic field sensor 248 (e.g., sensor feedback) to the controller 48. In some embodiments, the sensor controller 56 may be configured to analyze changes in the magnitude of the detected magnetic field to determine or calculate a change in temperature in the cement 32, and the sensor controller 56 may be configured to transmit the determined change in temperature in the cement (e.g., sensor feedback) to the controller 48.

Additionally, in some embodiments, the wellhead assembly 18 may be abandoned using one or more plugs 248 (e.g., mechanical plugs, bridge plugs, inflatable plugs, etc.) in the first annulus, the second annulus 174, and/or the annulus 240. The plugs 248 may be configured to form a fluid-tight seal to plug the respective annulus 34. That is, each plug 248 may be configured to form a fluid-tight seal with the surfaces defining the annulus 34 having the plug 248 to block or prevent the flow of fluid around the plug 248. The ESMs 52 and the cement additives 54 (e.g., the plurality of magnetic particles 244) may be disposed above the plug 248 (e.g., closer to the second surface 24) and/or below the plug 248 (e.g., farther from the second surface 24) to monitor well integrity parameters of the wellhead assembly 18 above and/or below the plug 248. Further, in some embodiments, one or more of the additional ESMs 242 may be installed with the plug 248. For example, an ESM 242 may be coupled to or disposed on an outer surface 250 (e.g., an axial surface, an upper axial surface) of the plug 248. It should be appreciated that FIG. 5 illustrates one example of an abandoned well 20 that may be monitored by the well integrity monitoring system 10, and the well integrity monitoring system 10 may be used to monitor well integrity parameters for wells 20 that have been abandoned using a variety of techniques, including permanent abandonment techniques and temporary abandonment techniques.

Figure 6:
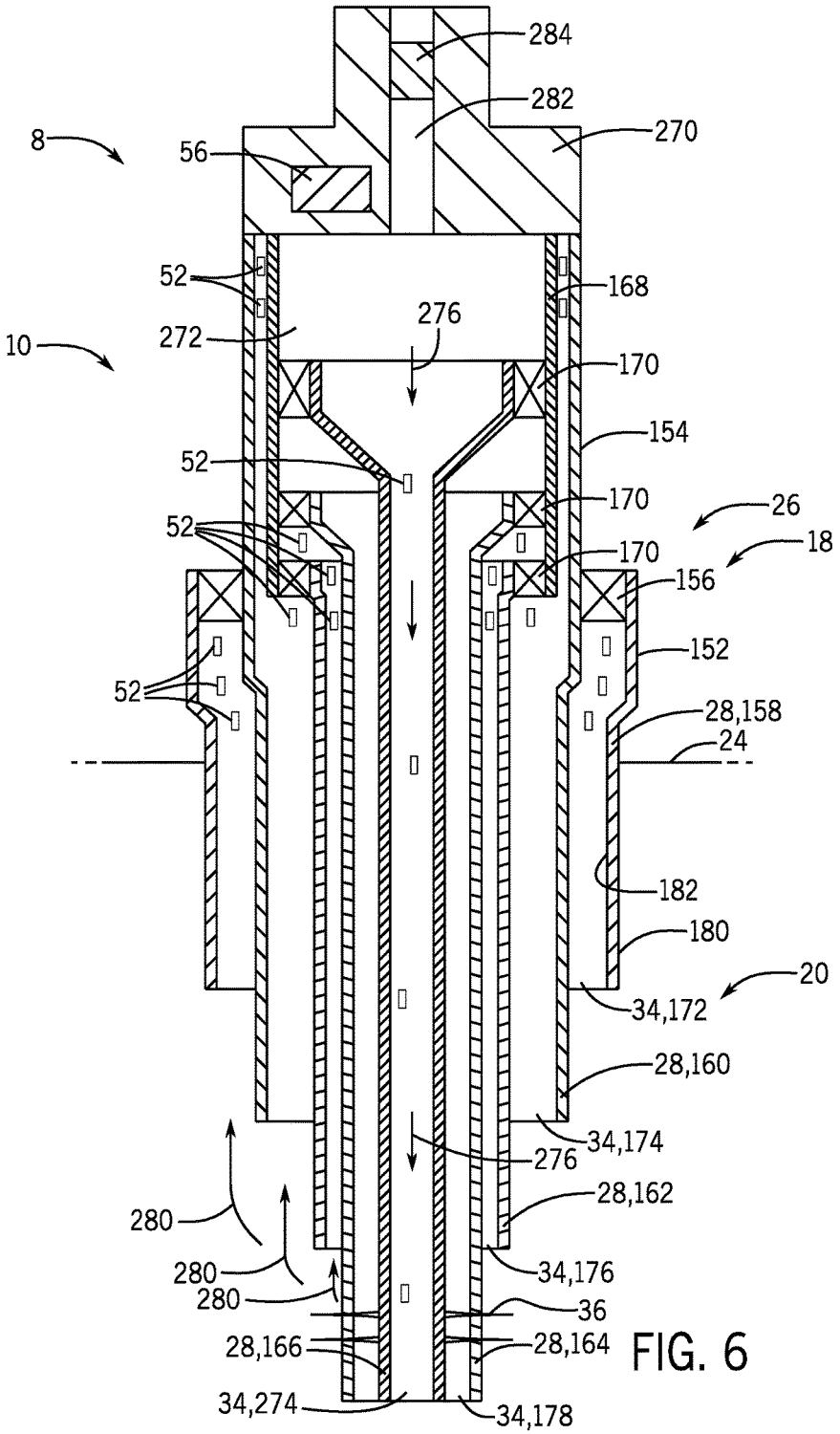
FIG. 6 is a cross-sectional view of an embodiment of the mineral extraction system of FIG. 1, where the well integrity monitoring system is configured to monitor integrity of a well during abandonment of the well.

FIG. 6 illustrates an embodiment of the wellhead assembly 18 and the well integrity monitoring system 10 during abandonment of the well 20 where an abandonment cap 270 (e.g., a corrosion-resistant cap) is coupled to the wellhead assembly 18. In some embodiments, the abandonment cap 270 may be coupled to an open upper axial end of the wellhead 26 and may be configured to block or prevent the flow of fluids from the annuli 34 of the wellhead assembly 18 to the second surface 24. For example, as illustrated, the abandonment cap 270 may be coupled to the high pressure wellhead housing 154 and may extend across (e.g., cover) the second annulus 174 and an annulus 272 of the inner annular surface 168 of high pressure wellhead housing 154. Specifically, the abandonment cap 270 may cover the annuli 174 and 272 of the high pressure wellhead housing 154 at an upper axial end 273 of the high pressure wellhead housing 154 (e.g., the end that faces the first surface 14 and faces away from the well 20). In some embodiments, the abandonment cap 270 may be used to permanently or temporarily abandon the well 20.

As illustrated, in some embodiments, the abandonment cap 270 may include the sensor controller 56. For example, the sensor controller 56 may be coupled to, disposed on, or integral with the abandonment cap 270. It should be appreciated that in some embodiments, the well integrity monitoring system 10 may include two or more sensor controllers 56, which may be disposed in the same or different locations. For example, the well integrity monitoring system 10 may include one sensor controller 56 disposed about the abandonment cap 270 and another sensor controller 56 disposed about the clamp connector 192 coupled to the conductor pipe 158.

In some embodiments, as discussed above, one or more ESMs 52 may be installed with one or more strings 28 of the wellhead assembly 18 and may be left in place during abandonment of the well 20. In certain embodiments, one or more ESMs 52 may be provided to the wellhead assembly 18 after drilling, completion, and/or production of the well 20. For example, a plurality of ESMs 52 may be pumped into an annulus 274 of the production tubing 166 as indicated by arrows 276. This may provide a random distribution of ESMs 52 in the wellhead assembly 18. In some embodiments, the ESMs 52 may be pumped into the wellhead assembly 18 (e.g., the annulus 274) after completion of the well 20 or during abandonment of the well 20. The ESMs 52 may flow out of the production tubing 166 and the production casing 164 through the perforations 36 and may flow up into the first, second, and third annuli 172, 174, and 176, as indicated by arrows 280. In some embodiments, the ESMs 52 may be pumped through the annulus 274 before the abandonment cap 270 is installed on the wellhead 26. In certain embodiments, the ESMs 52 may be pumped through a bore 282 in the abandonment cap 270. The abandonment cap 270 may also include a valve 284 disposed in the bore 284 to block or prevent the unintentional flow of fluids out of the wellhead assembly 18 through the bore 282. Further, in some embodiments, the ESMs 52 may be pumped into the wellhead assembly 18 (e.g., the annulus 274) with a cement slurry during completion and/or abandonment of the well 20, and the ESMs 52 may be fixed in place in the cement 32 when the cement 32 sets.

Figure 7:
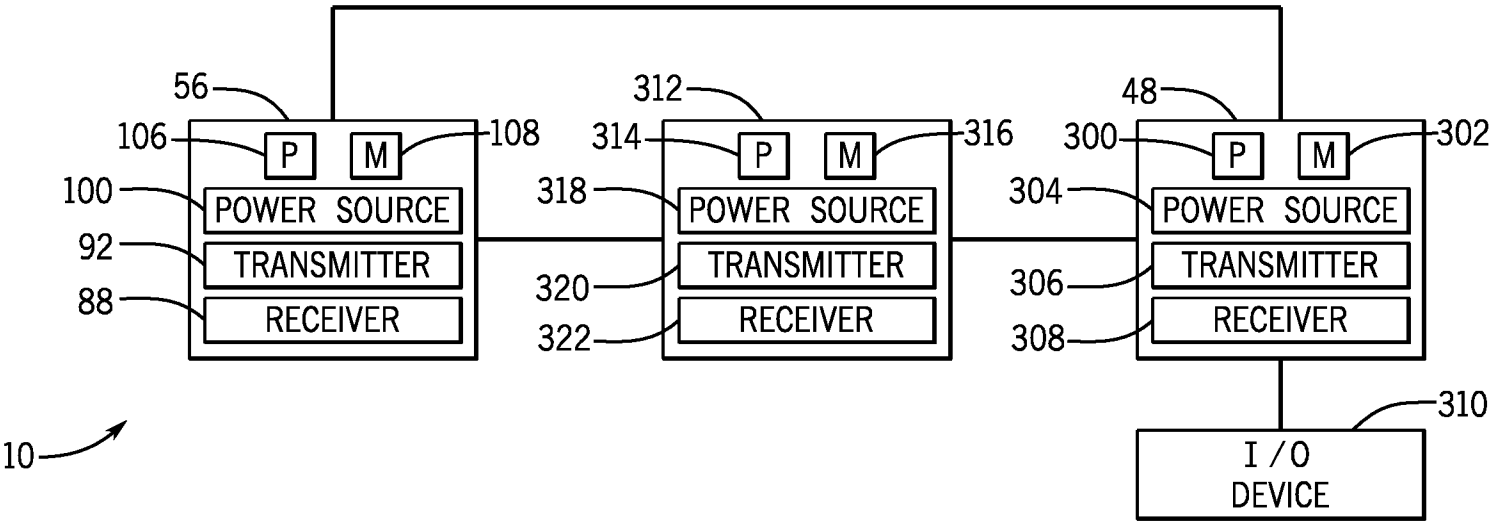
FIG. 7 is a block diagram of and embodiment of the well integrity monitoring system of FIG. 1 including a sensor controller, an intermediate controller, and a third controller.

FIG. 7 illustrates a block diagram of an embodiment of the well integrity monitoring system 10 including the sensor controller 56 and the controller 48. As illustrated, the controller 48 may include a processor 300, a memory 302, and a power source 304. The memory 302 may store instructions that may be accessed and executed by the processor 300 for performing the methods and processes described herein. Additionally, in some embodiments, the controller 48 may include a transmitter 306 and a receiver 308. The transmitter 306 and the receiver 308 may be configured to wirelessly transmit and receive, respectively, inductive signals, electromagnetic radiation (EM) signals (e.g., radio-frequency (RF) signals), acoustic signals, optical signals, mud pulse signals, or any other suitable wireless signal. Further, the controller 48 may include or may be operatively coupled to an input/output (I/O) device 310. The I/O device 310 may be configured to receive input from a user (or another electronic unit, computer, etc.) and to provide visual and/or audible indications to the user. For example, the I/O device 310 may include a display (e.g., a monitor or electronic device unit, a video screen), an audio output (e.g., a speaker), an electronic device or computer (e.g., a hand-held device, a tablet computer, a smartphone, a laptop computer, a desktop computer, a personal digital assistant, an industrial monitoring system, etc.), and so forth.

As discussed above, the sensor controller 56 may be configured to wirelessly receive or determine sensor feedback indicative of one or more well integrity parameters from the ESMs 52 and the cement additives 54. For example, the sensor feedback may be indicative of well integrity parameters such as the pressure and/or temperature of fluid within one or more annuli 34 of the wellhead assembly 18. Additionally, the sensor feedback may be indicative of well integrity parameters such as the stress, strain, bending, and/or inclination of one or more strings 28 of the wellhead assembly 18. Further, the sensor feedback may be indicative of well integrity parameters such as the temperature of the cement 32, the presence of cracks in the cement 32, a number of cracks in the cement 32, and/or a location of cracks in the cement 32 (e.g., a relative location to certain components). Still further, the sensor feedback may be indicative of the presence and/or flow rate of oil, gas, hydrocarbons, or other fluids in the cement 32.

As noted above, the sensor controller 56 may be configured to transmit the sensor feedback to the controller 48. In some embodiments, as noted above, the sensor controller 56 may transmit the sensor feedback wirelessly determined from the ESMs 52 and the cement additives 54 to the controller 48, or the sensor controller 56 may be configured to process and/or analyze the sensor feedback and may transmit processed and/or analyzed sensor feedback to the controller 48. For example, the processor 106 of the sensor controller 56 may be configured to determine values of one or more well integrity parameters and may transmit the determined values to the controller 48.

In some embodiments, the sensor controller 56 may be directly communicatively coupled to the controller 48. For example, the transmitter 92 of the sensor controller 56 may wirelessly transmit the sensor feedback directly to the receiver 308 of the controller 48. Additionally, the transmitter 306 of the controller 48 may be configured to wirelessly transmit control signals directly to the receiver 88 of the sensor controller 56. In certain embodiments, the sensor controller 56 may be communicatively coupled to the controller 48 via one or more intermediate controllers 312. For example, the one or more intermediate controllers 312 may include one or more subsea control modules, such as the subsea control module 62 of the BOP assembly 40 and/or the subsea control module 222 of the Christmas tree 220. In some embodiments, the one or more intermediate controllers 312 may include ROVs or AUVs.

As illustrated, the intermediate controller 312 may include a processor 314 and a memory 316. In some embodiments, the intermediate controller 312 may include a power source 318 (e.g., a battery and/or energy harvesting devices), a transmitter 320, and/or a receiver 322. The transmitter 320 and the receiver 322 may be configured to wirelessly transmit and receive, respectively, inductive signals, electromagnetic radiation (EM) signals (e.g., radio-frequency (RF) signals), acoustic signals, optical signals, mud pulse signals, or any other suitable wireless signal. In some embodiments, the intermediate controller 312 may be coupled to the controller 48 via a wired connection, such as the umbilical 64 (see FIG. 1). In certain embodiments, the intermediate controller 312 and the controller 48 may be configured to communicate wirelessly via the transmitters 306 and 320 and the receivers 308 and 322.

Further, in certain embodiments, the intermediate controller 312 may be coupled to the sensor controller 56 via a wired connection, such as the wire 224 (see FIG. 4). In some embodiments, the intermediate controller 312 and the sensor controller 56 may be wirelessly coupled via the transmitters 92 and 320 and the receivers 88 and 322. Accordingly, the sensor controller 56 may transmit the sensor feedback to the intermediate controller 312 wirelessly or via a wired connection, and the intermediate controller 312 may transmit the sensor feedback to the controller 48 wirelessly or via a wired connection. Additionally, in some embodiments, the intermediate controller 312 may be configured to transmit power from the power source 318 of the intermediate controller 312 and/or from the power source 304 of the controller 48 to the sensor controller 56. Further, in some embodiments, the intermediate controller 312 may be configured to transmit control signals from the processor 314 of the intermediate controller 312 and/or from the processor 300 of the controller 48 to the sensor controller 56.

In some embodiments, the processor 300 of the controller 48 may be configured to determine one or more well integrity parameters based on the sensor feedback. For example, the processor 300 may determine or calculate the stress, strain, bending (e.g., inclination), and/or lateral displacement of the conductor pipe 158, the surface casing 160, the intermediate casing 162, the production casing 164, any other string 28 of the wellhead assembly 18, and/or the wellhead assembly 18. In some embodiments, the processor 30 may determine or calculate the stress, strain, bending, lateral displacement, and/or structural integrity of the wellhead assembly 18 based on sensor feedback from one or more ESMs 52 configured to measure stress, strain, and/or bending (e.g., inclination) and attached to (e.g., disposed in a machined recess and/or coupled via an external connector or bracelet) the conductor pipe 158, the low pressure wellhead housing 152, and/or the high pressure wellhead housing 154. For example, the high pressure wellhead housing 154 may be coupled to various components, such as the BOP assembly 40 during drilling, the production tree 220 during production, a tieback connector, and so forth, and forces applied to such components (e.g., due to waves and/or current) may be transferred to the high pressure wellhead housing 154, which may cause the high pressure wellhead housing 154 to bend or deflect and may cause stress and/or strain on the high pressure wellhead housing 154. Further, the high pressure wellhead housing 154, which is coupled to the low pressure wellhead housing 152 and the conductor pipe 158, may transfer the forces to the low pressure wellhead housing 152 and the conductor pipe 158. As such, sensor feedback relating to the stress, strain, and/or bending of the low pressure wellhead housing 152 and/or the conductor pipe 158 may be indicative of the stress, strain, bending, lateral displacement, and/or structural integrity of the wellhead assembly 18.

Additionally, the processor 300 may determine or calculate the temperature and/or pressure in the cement 32, the first annulus 172, the second annulus 174, the third annulus 176, the fourth annulus 178, or any other annulus 34 of the wellhead assembly 18. Further, the processor 300 may determine or calculate a change in temperature in the cement 32 based on a change in magnitude of the magnetic field detected by the magnetic field sensor 248. Further, in some embodiments, the processor 300 may determine the presence, quantity, location, and/or severity of cracks, voids, and/or leaks in the cement 32 based on the determined well integrity parameters (e.g., the temperature in the cement 32 or a change in temperature in the cement 32), and/or based on sensor feedback (e.g., from a gas detector 80 or a hydrocarbon detector 80). Additionally, the processor 300 may cause the I/O device 310 to provide one or more user-perceivable indications based on the determined well integrity parameters and the presence, quantity, location, and/or severity of cracks, voids, and/or leaks in the cement 32. For example, the processor 300 may cause the I/O device 310 to display determined values of well integrity parameters, the number of cracks or leaks, the location of the cracks, voids, or leaks, and so forth. In some embodiments, the processor 300 may cause the I/O device 310 to provide a user-perceivable indication (e.g., alarms) in response to a determination that a value of a well integrity parameter violates a threshold and/or a determination that a value of a well integrity parameter has violated a threshold for a predetermined period of time.

Further, the processor 300 may be configured to determine the well integrity based on the determined well integrity parameters and/or based on determined information regarding cracks, voids, or leaks in the cement 32. In some embodiments, the processor 300 may compare the determined well integrity parameters to thresholds stored in the memory 302 and may determine the well integrity based on the comparison. For example, the processor 300 may determine that the well integrity is high if none of the determined well integrity parameters violate a respective threshold and if no cracks, voids, or leaks are identified. Additionally, the processor 300 may determine that the well integrity is low if one or more of the determined well integrity parameters violate a respective threshold, or if one or more cracks, voids, or leaks are identified. Additionally, the processor 300 may cause the I/O device 310 to provide user-perceivable indications related to the determined well integrity.

In some embodiments, the processor 300 may determine the well integrity using a model that predicts or estimates the well integrity based at least in part on the current values of well integrity parameters, historical values of well integrity parameters, trends in the values of the well integrity parameters over time, the locations about the wellhead assembly 18 where the well integrity parameters were measured, various events occurring in the system (e.g., blowout events, seismic events, etc.), and/or one or more characteristics of the wellhead assembly 18. For example, the characteristics of the wellhead assembly 18 used by the model may include the life of the wellhead assembly 18 (e.g., since the wellhead assembly 18 was drilled or completed), the depth of the wellhead assembly 18 below the first surface 14, the location of the wellhead assembly 18, the subterranean formation accessed by the wellhead assembly 18, the components of the wellhead assembly 18, and so forth.

In some embodiments, the processor 300 may determine different levels or degrees of well integrity based on the comparison. For example, the processor 300 may determine a first well integrity level in response to a determination that none of the determined well integrity parameters violate a respective threshold, a second well integrity level in response to a determination that one of the determined well integrity parameters violates a respective threshold, and a third well integrity level in response to a determination that two of the determined well integrity parameters violate respective thresholds. The second and third well integrity levels may be indicative of lower well integrity than the first well integrity level, and the third well integrity level may be indicative of lower well integrity than the second well integrity level. Further, the processor 300 may determine a well integrity level based on the amounts by which the determined well integrity parameters violate their respective thresholds, based on an amount of time that the determined well integrity parameters violated their respective thresholds, or a combination thereof. For example, the processor 300 may determine a well integrity level that is indicative of lower well integrity if a determined well integrity parameter significantly violates a respective threshold, violates a respective threshold for a long period of time, or both.

Further, the processor 300 may cause the I/O device 310 to display the determined well integrity level and/or to provide an alarm in response to a determination that the determined well integrity level exceeds a well integrity level threshold. Further, the processor 300 may be configured to determine when the wellhead assembly 18 may need to be repaired or serviced in order to maintain a desired level of well integrity based on the determined well integrity, and the processor 300 may cause the I/O device 310 to provide recommendations to service or repair the wellhead assembly 18 at a determined time. Accordingly, by providing the user with information relating to the well integrity, the well integrity monitoring system 10 may facilitate well integrity maintenance, which may increase the life of the well 20 and may reduce operating costs associated with the well 20.

The processors 106, 300, and 314 may each include one or more microprocessors, microcontrollers, integrated circuits, application specific integrated circuits, processing circuitry, and so forth. Additionally, the memory devices 84, 108, 302, and 316 may each be provided in the form of tangible and non-transitory machine-readable medium or media (such as a hard disk drive, etc.) having instructions recorded thereon for execution by a processor. The instructions may include various commands that instruct a processor to perform specific operations such as the methods and processes of the various embodiments described herein. The instructions may be in the form of a software program or application. The memory devices may include volatile and non-volatile media, removable and non-removable media implemented in any method or technology for storage of information such as computer-readable instructions, data structures, program modules or other data. The computer storage media may include, but are not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other suitable storage medium.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

Although the present disclosure has been described with respect to specific details, it is not intended that such details should be regarded as limitations on the scope of the invention, except to the extent that they are included in the accompanying claims.

The invention claimed is:

1. A subsea mineral extraction system, comprising:

a subsea wellhead assembly configured to couple to a well;

a first electronic sensor module configured to be disposed in cement in a first annulus of the subsea wellhead assembly, wherein the first electronic sensor module comprises:

a first sensor configured to measure or detect a parameter related to an integrity of the well;

control circuitry configured to generate sensor feedback based on the parameter measured or detected by the first sensor; and a first transmitter configured to wirelessly transmit the sensor feedback;

a first controller comprising a first receiver configured to wirelessly receive the sensor feedback from the first transmitter of the first electronic sensor module, and wherein the first controller is disposed on an outer annular surface of an outermost string of a plurality of strings of the subsea wellhead assembly; and a second controller configured to receive the sensor feedback from the first controller and to provide one or more user-perceivable indications based on the sensor feedback, wherein the second controller comprises a processor, a memory, and a model stored on the memory and executable by the processor, wherein the processor is configured to execute the model to predict or estimate the integrity of the well based at least in part on the sensor feedback.

2. The system of claim 1, wherein the processor is configured to execute the model to predict or estimate the integrity of the well based at least in part on at least one of: historical data associated with the well, trends in the parameter over time, one or more events occurring in the subsea mineral extraction system, a life of the subsea wellhead assembly, a depth or location of the subsea wellhead assembly, or a subterranean formation accessed by subsea wellhead assembly.

3. The system of claim 2, wherein the processor is configured to execute the model to predict or estimate the integrity of the well selectively based on each of historical data associated with the well, the trends in the parameter over time, one or more events occurring in the subsea mineral extraction system, a life of the subsea wellhead assembly, a depth or location of the subsea wellhead assembly, and a subterranean formation accessed by subsea wellhead assembly.

4. The system of claim 1, wherein the processor is configured to execute the model to determine different degrees or levels of the integrity of the well.

5. The system of claim 1, wherein the processor is configured to compare the sensor feedback against a threshold and determine if the sensor feedback violates the threshold.

6. The system of claim 5, wherein the processor is configured to determine a level of the integrity of the well based at least in part on one or both of: an amount of violation of the threshold or a duration of time of violation of the threshold.

7. The system of claim 1, wherein the first electronic sensor module is configured to operate in an operating mode selected from a plurality of operating modes depending on a stage of life of the well, and the control circuitry or the first controller is configured to set the operating mode.

8. The system of claim 1, wherein the control circuitry is configured to determine a value of the parameter measured by the first sensor and to cause the first transmitter to wirelessly transmit the sensor feedback in response to a determination that the value of the parameter violates a threshold.

9. The system of claim 8, wherein the sensor feedback comprises the value of the parameter.

10. The system of claim 8, wherein the sensor feedback comprises a signal with a frequency indicative of the value of the parameter, the first controller or the second controller is configured to determine that the value of the parameter violates the threshold based on the frequency of the signal, the signal has a first frequency if the value violates the threshold, and the signal has a second frequency if the value does not violates the threshold.

11. The system of claim 1, wherein the first electronic sensor module comprises an energy harvesting device configured to harvest energy for the first electronic sensor module from pressure pulses or acoustic signals received by the first electronic sensor module from the first controller.

12. The system of claim 1, wherein the first electronic sensor module comprises a second receiver, wherein the first controller comprises a first power source and a second transmitter, and wherein the second transmitter is configured to inductively transmit power from the first power source to the second receiver.

13. The system of claim 1, wherein the first sensor is configured to detect a presence of hydrocarbons in the cement, and wherein the second controller is configured to determine an integrity of the cement based on the sensor feedback.

14. The system of claim 1, wherein the system is configured to determine whether one or more cracks are present in the cement, whether fluid is flowing or leaking through the cement, the location of one or more cracks or leaks in the cement, and a degree or severity of the cracks or leaks in the cement.

15. A method, comprising:

coupling a controller to a subsea wellhead assembly comprising a plurality of coaxial casing strings that extend into a well, wherein the controller is disposed on an outer annular surface of an outermost coaxial casing string of the plurality of coaxial casing strings; and pumping a mixture through at least one annulus of the subsea wellhead assembly, wherein the mixture comprises a cement slurry and a plurality of electronic sensor modules mixed within the cement slurry, wherein at least a portion of the plurality of electronic sensor modules is configured to be fixed in place when the cement slurry hardens into cement, wherein each electronic sensor module of the plurality of electronic sensor modules is configured to measure or detect one or more parameters indicative of an integrity of the cement and to wirelessly transmit feedback indicative of the one or more measured or detected parameters to a receiver of the controller, wherein the controller is configured to process the feedback associated with the one or more parameters to determine whether one or more cracks, voids, or leaks are present in the cement, whether fluid is flowing or leaking through the cement, a location of the one or more cracks, voids, or leaks in the cement, and a degree or severity of the one or more cracks, voids, or leaks in the cement.

16. The method of claim 15, wherein a first electronic sensor module of the plurality of electronic sensor modules is configured to measure temperature, and wherein a second electronic sensor module of the plurality of electronic sensor modules is configured to detect a presence of hydrocarbons in the cement.

17. The method of claim 15, comprising adding a plurality of magnetic particles to the mixture in addition to the cement slurry and the plurality of electronic sensor modules, and wherein a magnetization of each magnetic particle of the plurality of magnetic particles is configured to change with temperature.

18. The method of claim 15, wherein coupling the controller to the subsea wellhead assembly comprises coupling an abandonment cap to the subsea wellhead assembly to abandon the well, wherein the controller is coupled to the abandonment cap.

* * * * *